US005749461A

United States Patent [19]

Guzman

[11] Patent Number: 5,749,461

[45] Date of Patent: May 12, 1998

[54] AIRTIGHT CIGAR PACKAGE

[76] Inventor: Eri Guzman, Guzman & Co Holdings Inc., P.O. Box 70106, San Juan, 00936-8106, Puerto Rico

[21] Appl. No.: 852,533

[22] Filed: May 7, 1997

[51] Int. Cl.[6] ..... B65D 85/12

[52] U.S. Cl. ..... 206/245; 206/256; 206/274

[58] Field of Search ..... 206/236, 242, 206/245, 247, 256–258, 260, 271, 274, 275

[56] References Cited

U.S. PATENT DOCUMENTS

| | | | |
|---|---|---|---|
| 894,475 | 7/1908 | Walker | 206/275 |
| 1,373,577 | 4/1921 | Vallens | 206/256 |
| 1,430,637 | 10/1922 | Gaede | 206/256 |
| 1,458,585 | 6/1923 | McCrosson . | |
| 2,005,039 | 6/1935 | Kayner | 206/258 |
| 3,325,000 | 6/1967 | Edwards | 206/256 |
| 3,371,775 | 3/1968 | Butler | 206/274 |
| 3,490,576 | 1/1970 | Alessi et al. . | |
| 3,574,642 | 4/1971 | Weinke . | |

FOREIGN PATENT DOCUMENTS 2130166 10/1983 United Kingdom .

*Primary Examiner*—Jimmy G. Foster
*Attorney, Agent, or Firm*—Richard C. Littman

[57] ABSTRACT

An airtight cigar package made up of rectangular, transparent front and rear sheets, which are made of 3 mil gauge polyethylene. The sheets are heat-sealed together to form an airtight envelope. The envelope has a head portion where a paper label is affixed. Sealingly stored within the envelope are four individually wrapped cigars with support members between and alongside the cigars to prevent crushing of the cigars during package transport and storage.

7 Claims, 2 Drawing Sheets

AIRTIGHT CIGAR PACKAGE

BACKGROUND OF THE INVENTION

1. Field of the Invention

The present invention relates to cigar packages and, more particularly, to transparent, airtight packages for protecting and storing cigars.

2. Description of Related Art

Of all of the tobacco smoking materials, cigars are the most sensitive to the environment and must be maintained in a humid environment to retain freshness and flavor. Cedar-lined humidors are often employed to maintain cigars in such a humid environment. Unfortunately, humidors are often prohibitively expensive for all but the most affluent cigar smoker. A more inexpensive alternative to the humidor is to keep cigars in an airtight environment to retain moisture, aroma and flavor.

Vacuum packaging of cigars and other goods are well known in the prior art. One such invention is described in U.S. Pat. No. 1,458,585 which issued to J. T. McCrosson on Oct. 2, 1922. This invention discloses a vacuum container for cigars, cigarettes and smoking tobacco. The container has longitudinal corrugations which prevent crushing of the cigars when the casing walls engage the cigars upon evacuation of air from the container. This invention does not employ transparent material to enable the purchaser to view the cigars in the container, nor does it employ heat sealing to ensure that no air enters or escapes the container.

U.S. Pat. No. 3,490,576 which issued to A. J. Alesi et al. on Jan. 20, 1970, discloses an air evacuated package having a pair of spaced apart pockets for holding a product. Each pocket comprises a flexible film affixed to a rigid tray by a heat seal. This invention is designed for packaging bacon and other limp products and does not provide for storing fragile cylindrical objects such as cigarettes and cigars.

Additionally, U.S. Pat. No. 3,574,642 which issued to K. F. Weinke on Apr. 13, 1971, discloses a package for and method of packaging meats. The package of this invention comprises an oxygen-impermeable outer and an oxygen-permeable inner layer, both layers enclosing meat products by heat of pressure sealing. Prior to store display, the outer layer is removed to allow air to permeate the inner layer, thereby turning the meat a bright red color.

U.K. Patent Application No. 2,130,166 A, published on May 31, 1984, discloses a vacuum skin package comprising a tray-like bottom with diverging walls, that is vacuum sealed with a plastic film and a sheet-like material.

None of the above inventions and patents, taken either singularly or in combination, is seen to describe the instant invention as claimed. Thus, an airtight cigar package solving the aforementioned problems is desired.

SUMMARY OF THE INVENTION

The present invention is an airtight cigar package. The invention is made up of a rectangular transparent front sheet and a rectangular transparent rear sheet. Both sheets are made of three-mil gauge polyethylene and are heat-sealed together to form an airtight envelope. The top portions of the front sheet and the rear sheet extend from the envelope to form a head portion, and a paper label may be safely affixed to the head portion without puncturing the envelope.

Stored in a sealed manner within the envelope are four individually wrapped cigars and a plurality of support members disposed between and alongside the cigars to prevent crushing of the cigars during transport and storage.

According to a second embodiment, substantially all the air is evacuated from the envelope to allow the top, bottom and inner walls of the envelope to engage the peripheral portions and ends of both the support members and the cigars.

Accordingly, it is a principal object of the invention to provide an airtight cigar package that preserves the flavor, freshness and aroma of a cigar or cigars.

It is another object of the invention to provide a storage container or package for cigars that prevents breakage of the cigar.

It is a further object of the invention to provide an airtight cigar package whereby the contents are made visible to the consumer to aid and enhance his or her purchasing decision.

It is an object of the invention to provide improved elements and arrangements thereof in an airtight cigar package for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
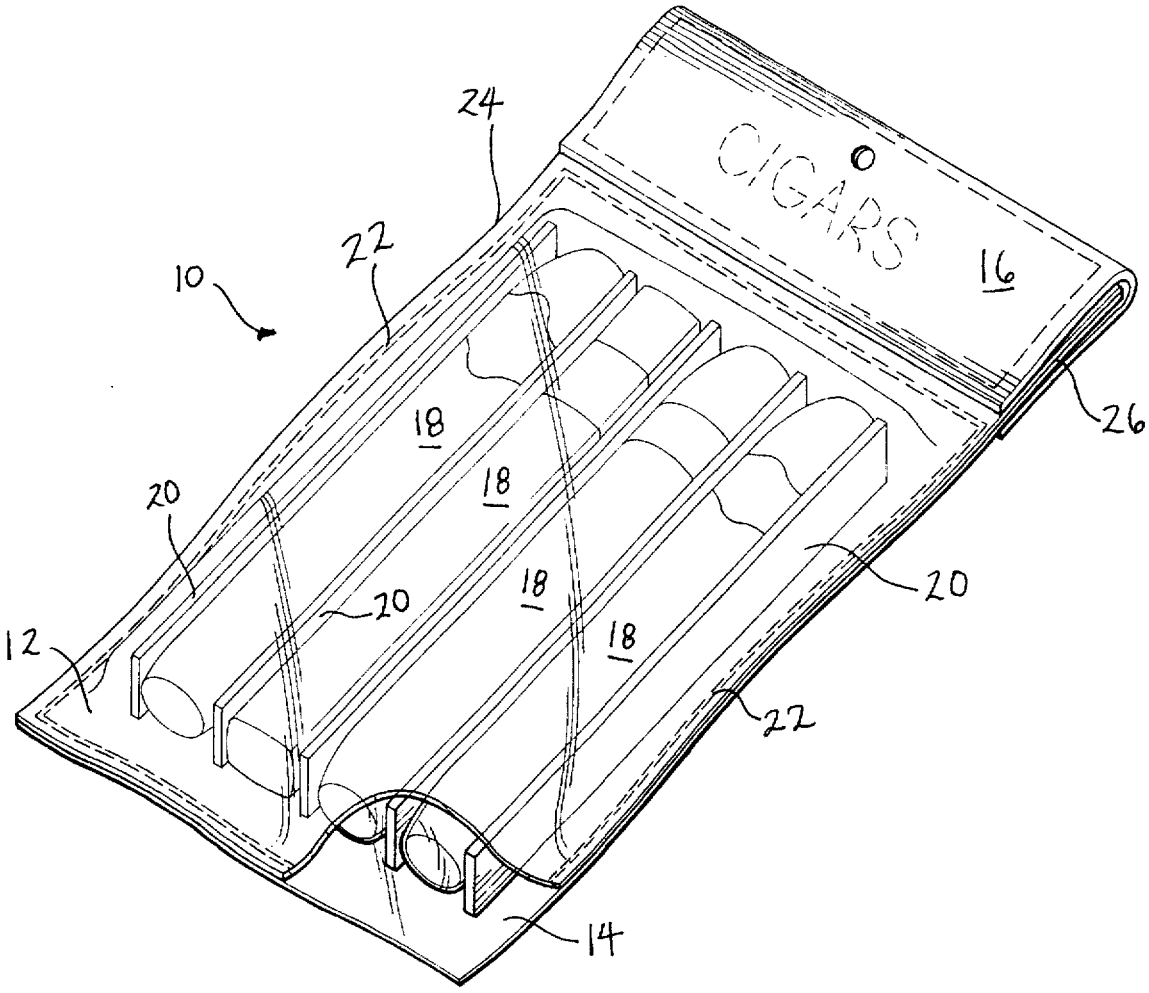
FIG. 1 is an environmental, perspective view of an airtight cigar package with a portion of its front sheet broken away to show internal details, according to a first embodiment of the present invention.
Figure 2:
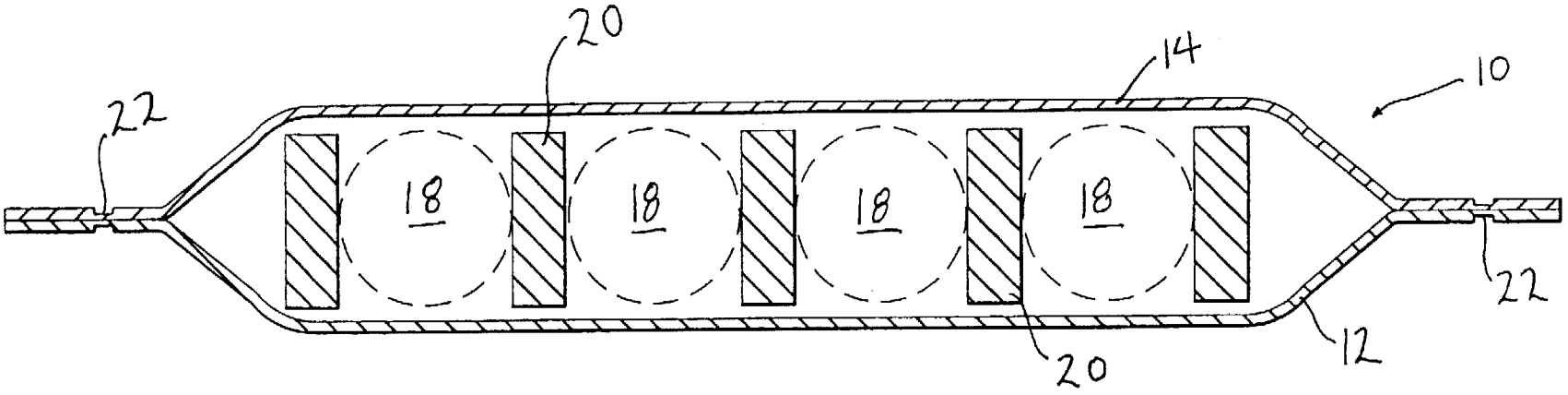
FIG. 2 is a cross-sectional view of the first embodiment of the present invention.
Figure 3:
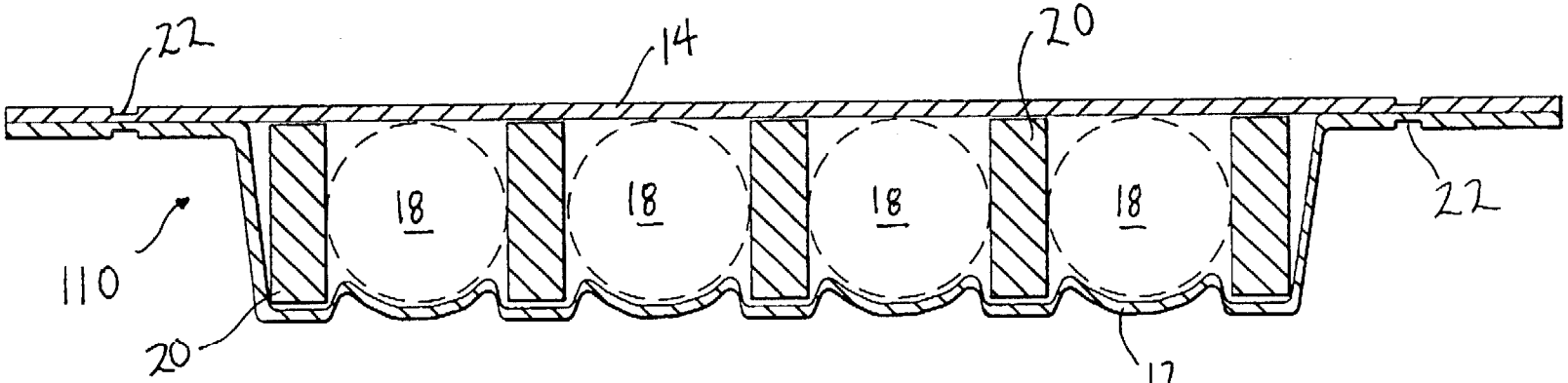
FIG. 3 is a cross-sectional view of the second embodiment of the present invention.

Referring now to the drawings wherein like numerals represent like parts, FIG. 1 is a perspective view of the airtight cigar package 10 according to the preferred embodiment of the present invention. The package 10 comprises a front sheet 12, a rear sheet 14, and a label 16, and is dimensioned (in this particular embodiment) to contain four individually wrapped cigars 18. Positioned between each cigar 18 is a support member 20, which is dimensioned and positioned to prevent the crushing of the cigars during transport and storage. As shown in FIGS. 1, 2 and 3, additional support members 20 may be used between the two outer cigars and the side walls of the envelope 24. FIG. 2 is a cross-sectional view illustrating the supportive relationship between the support members 20 the cigars 18. The support members 20 are ideally comprised of corrugated cardboard, but may be comprised of other strong yet lightweight materials in alternative embodiments.

Referring to FIGS. 1 and 2 generally, both the front sheet 12 and the rear sheet 14 are ideally comprised of transparent polyethylene having a thickness of three mils, but in alternative embodiments, both sheets may be made of other flexible and oxygen-impermeable packaging materials of varying thickness. The cigars 18 and support members 20 are sealed between the front sheet 12 and the rear sheet 14 by a heat seal 22 present about the entire periphery of the two sheets, thereby forming an airtight envelope 24. The top portions of the front sheet and the rear sheet extend from the envelope 24 to form a head portion 26 whereby the label 16 may be safely affixed to the head portion without puncturing the envelope.

FIG. 3 is a cross sectional view of a second embodiment of the cigar package 110. While structurally similar to the cigar package 10 of the first embodiment, the second embodiment has substantially all the air evacuated from the envelope 24, thereby allowing the top, bottom and inner walls of the envelope to engage the peripheral portions and ends of both the support members 20 and the cigars 18. Air may be evacuated from the envelope 24 by any conventional apparatus for air evacuation.

It is to be understood that the present invention is not limited to the embodiments described above, but encompasses any and all embodiments within the scope of the following claims.

I claim:

1. An airtight cigar package comprising:

a transparent front sheet and a transparent rear sheet;

a plurality of individually wrapped cigars;

a heat seal extending continuously around the periphery of said front sheet and said rear sheet, and connecting said front and rear sheets together, thereby forming an airtight envelope to sealingly contain said plurality of cigars therein; and a first plurality of rectangular support members, each of said first plurality of support members positioned intermediate adjacent cigars and being substantially the same height and the same length as said plurality of cigars.

2. The airtight cigar package as defined in claim 1, said cigars lying in a single plane such that there are two end cigars, there further being a pair of second rectangular support members, each of said second support members being positioned intermediate a said end cigar and an edge of said envelope, and being substantially the same height and the same length as said end cigar.

3. The airtight cigar package as defined in claim 1, wherein said transparent front sheet and said transparent rear sheet are made of polyethylene.

4. The airtight cigar package as defined in claim 3, wherein said transparent front sheet and said transparent rear sheet each have a thickness in the range of 3 mils.

5. The airtight cigar package as defined in claim 1, wherein said rectangular support members are made of cardboard.

6. The airtight cigar package as defined in claim 1, wherein substantially all air is evacuated from said envelope, such that a vacuum sealed package is thus formed.

7. An airtight cigar package comprising:

a rectangular transparent front sheet and a rectangular transparent rear sheet, both of said sheets made of polyethylene having a thickness in the range of 3 mils;

four individually wrapped cigars;

a heat seal extending continuously around the periphery of said front sheet and said rear sheet, and connecting said front and rear sheets together, thereby forming an airtight envelope to sealingly contain said four cigars therein, said heat seal configured so as to define an envelope top end with a one and one half inch head;

a paper label affixed to and embracing said head portion of said top of said rectangular envelope; and five rectangular cardboard support members, each of said support members being substantially the same height and the same width as said four cigars, three of said support members positioned intermediate adjacent ones of said four cigars, and two of said support members positioned intermediate end ones of said four cigars and an edge of said envelope.

* * * * *